US005947523A

United States Patent [19]

Liegard

[11] Patent Number: 5,947,523

[45] Date of Patent: Sep. 7, 1999

[54] ARCHIVING SYSTEM FOR COUNTERFOIL BOOKS

[76] Inventor: Gilles Liegard, 3 Rue Blaise Pascal, Le Kremlin Bicetre, France, 94270

[21] Appl. No.: 08/875,369

[22] PCT Filed: Jan. 23, 1996

[86] PCT No.: PCT/FR96/00103

§ 371 Date: Jul. 24, 1997

§ 102(e) Date: Jul. 24, 1997

[87] PCT Pub. No.: WO96/22887

PCT Pub. Date: Aug. 1, 1996

[30] Foreign Application Priority Data

Jan. 25, 1995 [FR] France ..... 95/00814

[51] Int. Cl.[6] ..... B42F 11/00

[52] U.S. Cl. ..... 281/28; 281/44; 281/45; 281/51

[58] Field of Search ..... 281/28, 44, 45, 281/46, 50, 51; 402/70, 73, 500, 502, 80 R; 220/507; 312/185, 186, 187, 193, 223; 211/45, 42, 50, 11; 40/124.01

[56] References Cited

U.S. PATENT DOCUMENTS

| | | | |
|---|---|---|---|
| 1,317,202 | 9/1919 | Leonard . | |
| 1,365,935 | 1/1921 | Moran . | |
| 1,522,077 | 1/1925 | Rand . | |
| 1,554,087 | 9/1925 | Hardy . | |
| 1,731,180 | 10/1929 | Sherman . | |
| 1,774,240 | 8/1930 | Rand . | |
| 1,882,782 | 10/1932 | Dawson . | |
| 1,914,685 | 6/1933 | Dawson . | |
| 1,990,020 | 2/1935 | Blackwood . | |
| 2,848,828 | 8/1958 | Cawley . | |
| 3,159,404 | 12/1964 | Midgley et al. . | |
| 3,288,543 | 11/1966 | Sugerman . | |
| 3,357,569 | 12/1967 | Goodman et al. . | |
| 3,620,553 | 11/1971 | Donovan . | |
| 3,662,481 | 5/1972 | Lewis, Jr. . | |
| 3,798,810 | 3/1974 | Brisson et al. . | |
| 4,425,727 | 1/1984 | Waldenkrantz . | |
| 4,445,710 | 5/1984 | Borel | 281/45 |
| 5,153,041 | 10/1992 | Clements | 281/15.1 |

FOREIGN PATENT DOCUMENTS

| | | |
|---|---|---|
| 8902477 | 5/1991 | Netherlands . |

*Primary Examiner*—Frances Han

*Attorney, Agent, or Firm*—Ostrolenk, Faber, Gerb & Soffen, LLP

[57] ABSTRACT

A device for filing and archiving books of check stubs and other, similar documents, and also the counterfoils of any register. The invention relates to a device for enabling the above-specified documents to be stored in a manner that is appropriate for accountancy filing and thereby obtain considerable saving in time during accounting, searching, and handling, together with protection against damage due to intensive handling. The device comprises a rectangular plate (5) slotted by parallel vertical rectangles (6) into which previously folded-back covers (1) are inserted, and also a sliding second rectangular plate (10). The second plate (10) when fitted to the first (5) serves to hold the documents (2) pressed thereagainst. The device of the invention is mainly intended for filing and archiving books of bank check stubs.

6 Claims, 4 Drawing Sheets

ARCHIVING SYSTEM FOR COUNTERFOIL BOOKS

The present invention relates to a device for filing and archiving books of check stubs and other similar documents, and also of counterfoils of any register. The idea is to enable such documents to be stored in a manner that is appropriate for accountancy filing, to obtain a considerable saving in time during accounting, searching, and handling, and to provide protection against damage due to intensive handling.

The above-indicated documents are traditionally piled into bags, tins, boxes, or drawers, thus giving rise to searches that are lengthy and fiddly and giving rise to a daily risk of damage.

The device of the invention enables those drawbacks to be remedied. It comprises a rectangular plate made up of rectangular vertical sections in which the covers of the documents are inserted, and a sliding second rectangular plate, which plate fits on the first and enables the documents to be kept pressed.

The accompanying drawings show the invention.

With reference to the drawings, it is necessary to prepare documents for insertion into the device.

Figure 1:
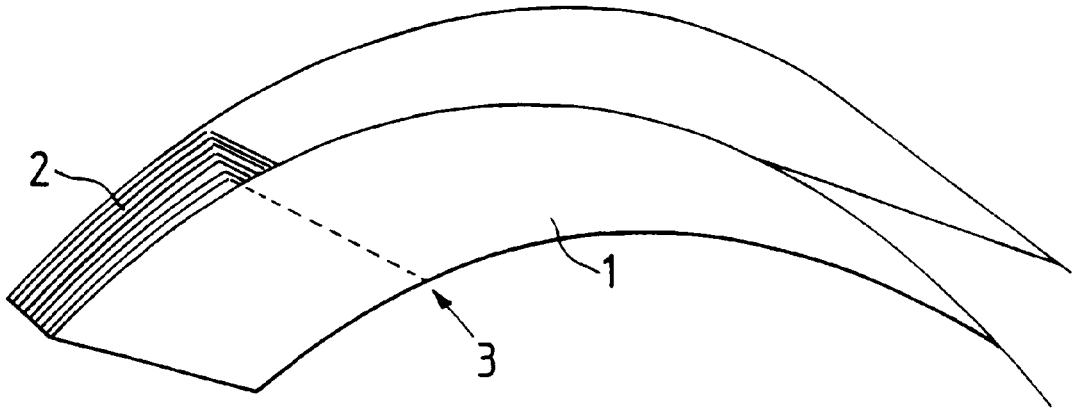
FIGS. 1 and 2 show how a document is prepared for use with the invention.
Figure 2:
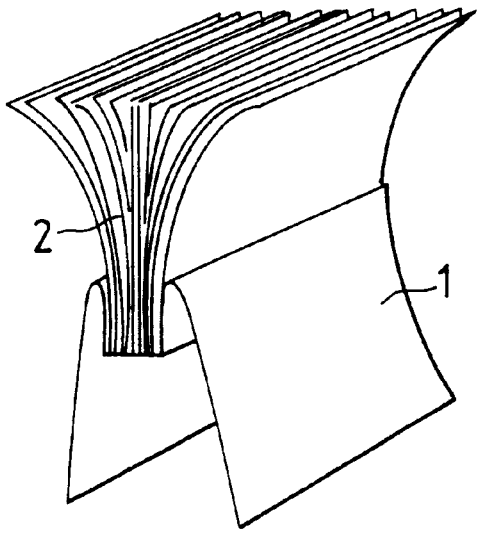
Figure 3:
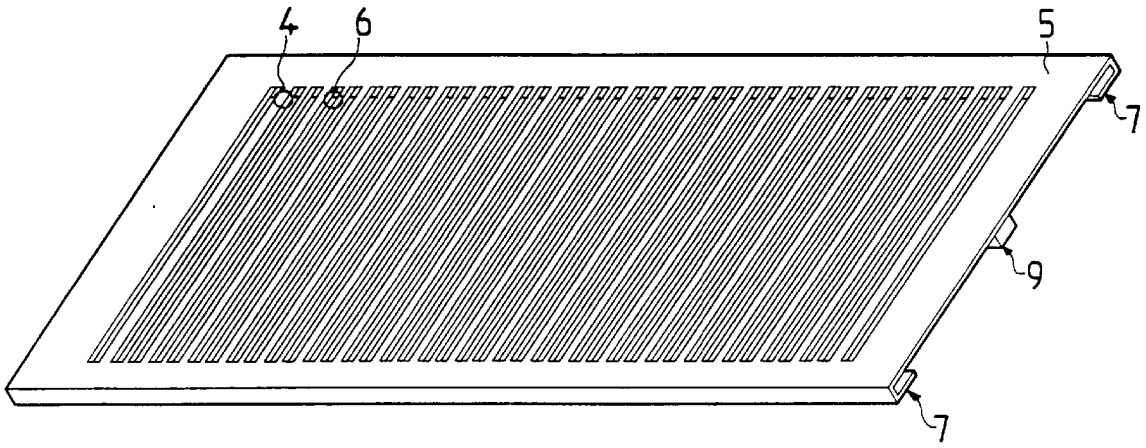
FIG. 3 shows the first plate of the invention.
Figure 4:
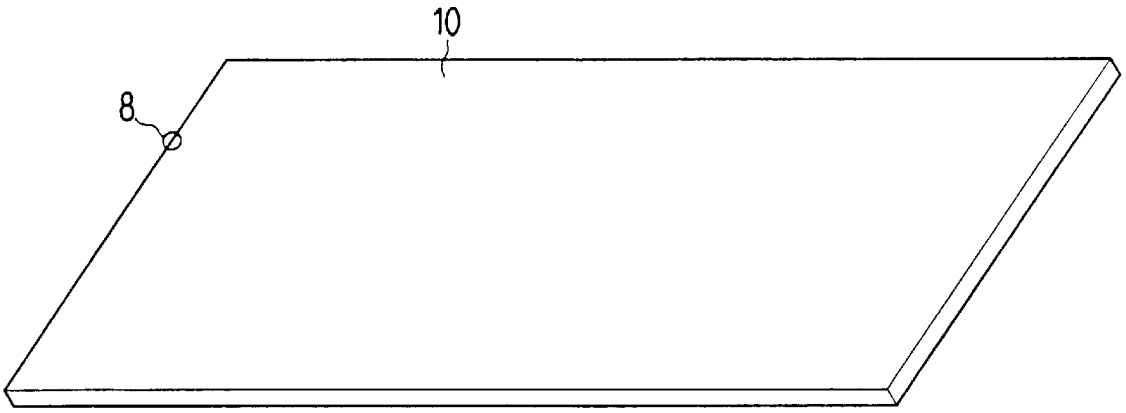
FIG. 4 shows the second plate of the invention.
Figure 5:
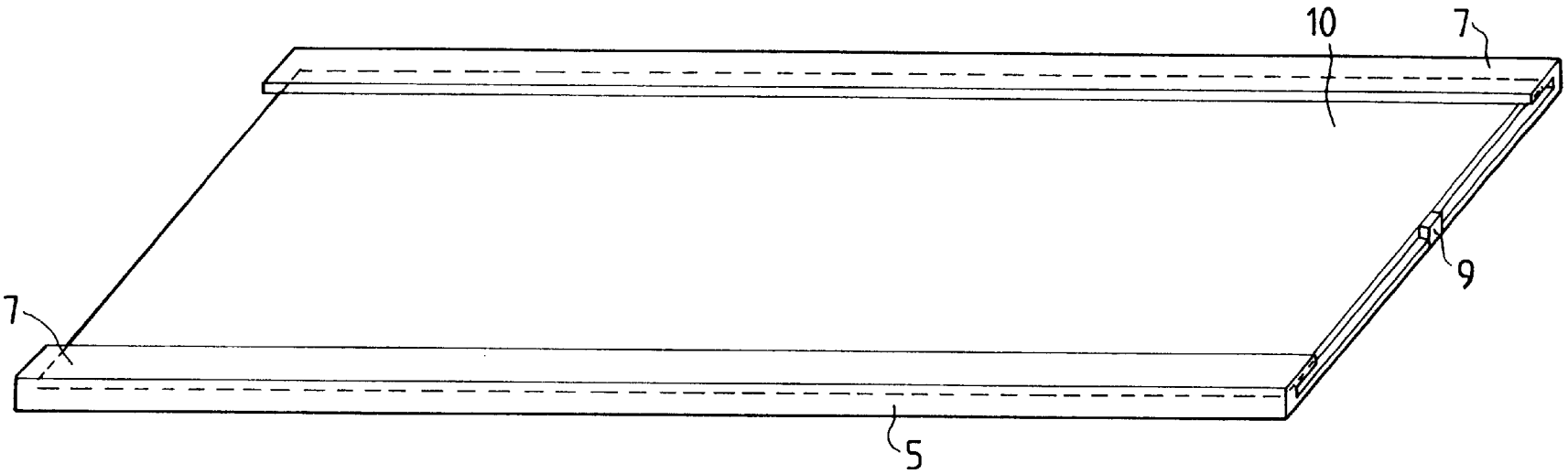
FIG. 5 shows the device comprising the two superposed plates of the invention.
Figure 6:
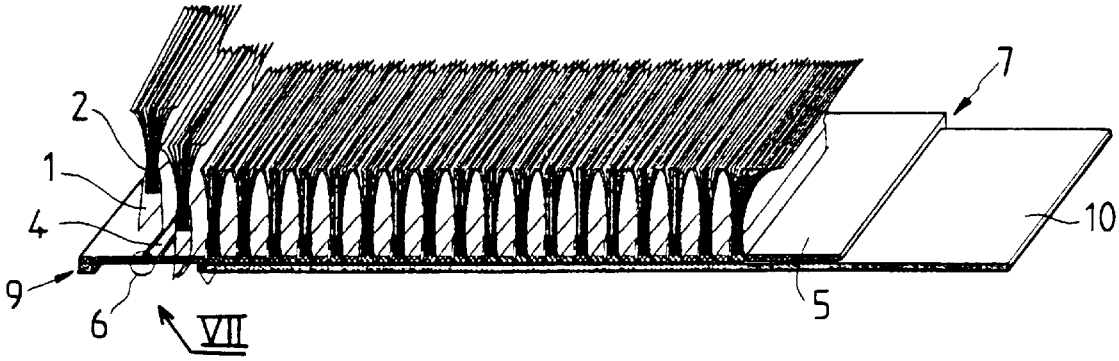
FIG. 6 is a section view showing documents together with a half-closed device of the invention.
Figure 7:
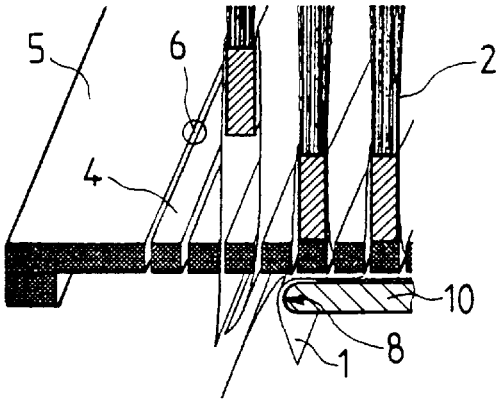
FIG. 7 is a section view showing the curved-edge of the device of the invention together with documents.

The covers (1) of the documents must be cut off flush (3) with the stubs (2). See FIG. 1.

After being cut off in this way, the covers (1) are folded back so as to enable each folded-back cover to be inserted in a section (6), with the spine of the book thus being held flat against a solid bar (4).

With reference to the drawings, the device comprises:

A support plate (5) pierced by parallel vertical rectangles (6) of length equivalent to the height of a book (2) and slightly wider than the thickness of the covers (1) of the documents they are to receive; solid surfaces (4) between these sections are of a width equivalent to the thickness of the documents they are to support. The long edges of the plate are folded-over as U-shapes (7) with the webs of the U-shapes (7) being of a thickness suitable for leaving a gap that is large enough to receive the second plate (10) plus the folded covers (1) that are jammed in this way between the two plates. One of the short sides includes a center tab (9), and the end of the second plate (10) comes into abutment against the bottom thereof.

A second plate (10) is slightly smaller than the above-described support plate (5) and has one of its short edges (8) rounded in such manner that, when the second plate (10) is slid along the first, it folds down and flattens the covers (1) of the stubs (2), but without damaging them.

In a variant (not shown), the device for assembling together the two plates in order to fold and jam the covers (1) of the documents, can be implemented by fastening means, such as nuts and bolts, or paper fasteners.

In another variant (not shown), the support plate device (5) for receiving the ends of the covers (1) in the sections (6) could be pierced with horizontal rectangles to enable documents such as wallet-style check stub books to be received, lengthwise.

As a non-limiting example, the device may be about 27 cm long and 12 cm wide, for a thickness of 4.5 mm.

The device of the invention is particularly intended for filing and archiving books of bank check stubs. Commercial law requires businesses to conserve documents constituting accounting records for a period of ten years.

Industrial application is necessary to cover the number of legal documents to be archived in application of the invention, which can amount to about twenty such books. Depending on various methods of manufacture, the raw material used can be aluminum or a plastics material, and it appears that a molding operation is the most suitable for making the shapes required by the invention.

I claim:

1. The device for filing and archiving books of check stubs, and also any register counterfoils, comprising a support plate (5) pierced by parallel vertical rectangles (6) enabling the folded covers (1) of the documents (2) to be inserted therein, with the long edges of the plate being folded under in a U-shape (7); thus enabling a second plate (10) to slide inside the support plate (5), thereby folding over the covers (1) which are thus jammed between the two plates.

2. A device according to claim 1, wherein one of the two short sides of the support plate (5) includes a center tab (9) for engaging the second plate (10).

3. A device according to claim 1, wherein one of the two short sides (8) of the second plate (10) is curved (8) so as to fold-over and flatten the covers (1) of the stubs (2).

4. A device according to claim 1, wherein the two plates are assembled together by pressure from a nut and bolt.

5. A device according to claim 1, wherein the two plates are assembled together by pressure from paper fasteners.

6. A device according to any of the preceding claim, wherein the support plate (5) is pierced with horizontal rectangles (6) enabling use for documents having a different page format.

* * * * *